US011767165B2

(12) United States Patent
Abang, Jr.

(10) Patent No.: US 11,767,165 B2
(45) Date of Patent: Sep. 26, 2023

(54) BIN

(71) Applicant: Robert Owan Abang, Jr., Tampa, FL (US)

(72) Inventor: Robert Owan Abang, Jr., Tampa, FL (US)

(73) Assignee: Robert Owan Abang, Jr., Brandon, FL (US)

( * ) Notice: Subject to any disclaimer, the term of this patent is extended or adjusted under 35 U.S.C. 154(b) by 299 days.

(21) Appl. No.: 17/227,898

(22) Filed: Apr. 12, 2021

(65) Prior Publication Data

US 2021/0229906 A1 Jul. 29, 2021

Related U.S. Application Data

(63) Continuation-in-part of application No. 16/578,560, filed on Sep. 23, 2019, now abandoned.

(51) Int. Cl.
*B65F 1/06* (2006.01)
*B65F 1/16* (2006.01)

(52) U.S. Cl.
CPC ..... *B65F 1/1607* (2013.01); *B65F 1/06* (2013.01); *B65F 1/163* (2013.01)

(58) Field of Classification Search
CPC ..... B65F 1/04; B65F 1/06; B65F 1/08; B65F 1/085; B65F 1/163; B65F 1/1607; B65D 21/0233; B65D 21/086
USPC ..... 220/495, 495.01, 495.06–495.11; 248/99–101
See application file for complete search history.

(56) References Cited

U.S. PATENT DOCUMENTS 2,451,829 A * 10/1948 Hightower ..... B65B 67/12 248/100
5,092,105 A * 3/1992 Bish-Shin ..... B65F 1/06 D34/9
5,183,228 A * 2/1993 Curry ..... B65F 1/06 D34/10
5,190,183 A * 3/1993 McNaughton ..... B65F 1/06 220/495.11
5,238,139 A * 8/1993 Bisceglia ..... B65F 1/06 248/101
6,629,622 B1 * 10/2003 Abzaletdinov ..... B65F 1/062 220/495.07
8,136,688 B2 * 3/2012 Lee ..... B65F 1/163 220/264
8,950,620 B1 * 2/2015 McDuffie ..... B65F 1/067 220/495.01

(Continued)

FOREIGN PATENT DOCUMENTS

CN 111573048 A * 8/2020 ..... B65F 1/06
CN 112208965 A * 1/2021 ..... B65F 1/06

*Primary Examiner* — Joshua E Rodden

(57) ABSTRACT

The current invention relates to a bin used in combination with a liner for various purposes, including but not limited to the disposal of trash and the collection of recycled material. The bin having an exterior surface, an interior surface, a body, a closed bottom end, an open top end, and an interior chamber. The bin including at least a slideable top portion allowing for the top opening of the bin to be adjusted in periphery thereby enabling liners of various sizes to be secured in the interior chamber of the bin. In addition, a bin including of a lid with an adjustable member securable within the bin lid enabling liners of various sizes to be secured in the interior chamber of the bin.

24 Claims, 18 Drawing Sheets

(56) References Cited

U.S. PATENT DOCUMENTS

| | | | | |
|---|---|---|---|---|
| 10,093,443 | B2 * | 10/2018 | Strom | B65F 1/1415 |
| 2006/0273089 | A1 * | 12/2006 | Chiou | B65F 1/163<br>220/262 |
| 2012/0060706 | A1 * | 3/2012 | Brown | B65F 1/1646<br>100/211 |
| 2015/0274379 | A1 * | 10/2015 | Hall | B65D 47/0895<br>220/796 |
| 2016/0137412 | A1 * | 5/2016 | Capetillo | B65F 1/085<br>220/529 |
| 2018/0282058 | A1 * | 10/2018 | Rana | B65F 1/06 |
| 2019/0152698 | A1 * | 5/2019 | Zhao | B65F 1/06 |

* cited by examiner

BIN

CROSS REFERENCE TO RELATED APPLICATION

This application is a continuation-in-part of U.S. Utility patent application Ser. No. 16/578,560 filed Sep. 23, 2019, which is a continuation of U.S. Utility patent application Ser. No. 15/461,775 filed Mar. 17, 2017 now U.S. patent Ser. No. 10/513,390, and incorporated herein by reference.

TECHNICAL FIELD OF THE INVENTION

The present invention relates to bins which are commonly used in combination with a liner in a variety of applications, particularly but not limited to the disposal of trash and the collection of recycled material. These bins come in various shapes and sizes, and are usually made of forms of metal, plastic, aluminum, steel, a combination of and/or other suitable material.

BACKGROUND OF THE INVENTION

For years disposable bags used for bagging groceries, shopping and more are commonly being re-used in combination with bins as liners. These liners are inserted into the bin and later removed from the bin and used to carry the accumulated contents to dispose of or recycle into a larger container or at a location for disposal (e.g. into a dumpster or at the curb for pickup by a trash/recycling collection service). Majority of these liners however cannot be inserted into standard size bins because the liners are too small and therefore the top opening of the liner is unable to go around the top portion of the bin. Some other liners are wide enough to be inserted into a bin but these liners however after being inserted into the bin most times fall into the bin after trash or other material have been thrown in them because they are too short to reach the floor of the bin. Therefore, these liners don't function properly because they are either too small to go around the top portion of the bin or too short to reach the floor of the bin. Due to this, a lot of consumers instead of making a second productive use out of these liners end up just disposing of them too quickly. There is therefore a need for an improved bin capable of accommodating liners of all sizes. Current bins available today do not address this need.

DESCRIPTION OF THE PRIOR ART

Bins for disposal of trash and collection of recycled material typically involve the use of a liner. These liners come in various sizes to be inserted into the interior chamber of the bin. Most bins also come with bin lids, which are utilized as just a cover for the bins for covering the contents disposed within the interior chamber of the bin. However due to the rigid structure of the bin and bin lids, liners of different sizes cannot all fit in the interior chamber of the bin because the top opening of the liner is unable to go around the top portion of the bin, and therefore cannot be effectively used as a liner:

U.S. Pat. No. 7,624,915 issued to Dembowiak et al describes a recycling center having a receiving chamber. A bag support having a first rail, second rail, and support bar is slidably mounted to the walls of the receiving chamber. The bag support is movable between a first position wherein the bag support is within the receiving chamber, and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,042,703 issued to Dembowiak describes a recycling center having a receiving chamber. A bag slide comprising of a first rail, second rail, at least a rod extending between the first and second rails, and pivotable bag retainers slidably mounted to the walls of the receiving chamber. The bag slide is movable between a first position wherein the bag support is within the receiving chamber and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,302,916 issued to Dembowiak et al describes a bag support comprising of a first bar, second bar, at least a support extending between first and second bar, and pivotable bag retainers extending from the bar to support a bag. The bag retainers pivotable between a first position and a second bag retaining position. The invention does not relate to a bin with the ability to extend and retract the top upper portion of the bin, or an adjustable bin lid for liners of different sizes to fit in the interior chamber of the bin.

U.S. Pat. No. 5,803,299 issued to Sealy Jr describes a bag support insert with telescoping members mounted on the upper edges of a container with bag support pegs for supporting a trash bag. This invention is not part of the container and does not relate to a bin with the ability to extend and retract the top upper portion of the bin, or an adjustable bin lid for liners of different sizes to fit in the interior chamber of the bin.

U.S. Patent Application No. 20070062953 issued to Lin describes a trashcan with at least a cover comprised of two parallel sliding portions having a rail and a track to open and close the trashcan. The purpose of this invention is to cover the contents disposed within the bin interior chamber and does not relate to a bin with the ability to extend and retract the top upper portion of the bin, or an adjustable bin lid for liners of different sizes to fit in the interior chamber of the bin.

U.S. Pat. No. 8,378,597 issued to Shek describes a cover assembly comprising of two parts. The first part having an open hole and the second part having guide slots on two sidewalls and a plurality of sliding plates to open and close the hole. The purpose of this invention is to open and close access to the interior chamber of the bin and does not relate to a bin with the ability to extend and retract the top upper portion of the bin, or an adjustable bin lid for liners of different sizes to fit in the interior chamber of the bin.

U.S. Pat. No. 7,290,674 issued to Ledford describes a trash bin comprising of a plurality of lids, a divider member, and bag supporting members pivotally connected to the trash bin. The bottom of the bag supporting members engageable with the top edge portions of a trash bag when the bag supporting member is lowered on to the trash bin to secure the trash bag. The purpose of this invention is to secure a trash bag inserted into a trash bin and does not relate to a bin with the ability to extend and retract the top upper portion of the bin, or an adjustable bin lid for liners of different sizes to fit in the interior chamber of the bin.

None of the above inventions relates to a bin with the ability to extend and retract the top upper portion of the bin or an adjustable bin lid for liners of different sizes to fit in the interior chamber of the bin.

BRIEF SUMMARY OF THE INVENTION

The current invention relates to an improved bin used in combination with a liner for various purposes, including but not limited to the disposal of trash and the collection of recycled material. The bin having an exterior surface, an interior surface, a body, a closed bottom end, an open top end, and an interior chamber. The bin comprising of at least a slideable top portion allowing for the top opening of the bin to be adjusted in periphery thereby enabling liners of various sizes to be secured in the interior chamber of the bin.

In addition, a bin comprising of an adjustable bin lid member within a bin lid enabling liners of various sizes to be secured in the interior chamber of the bin.

DETAILED DESCRIPTION OF THE EMBODIMENTS OF THE INVENTION

Figure 1:
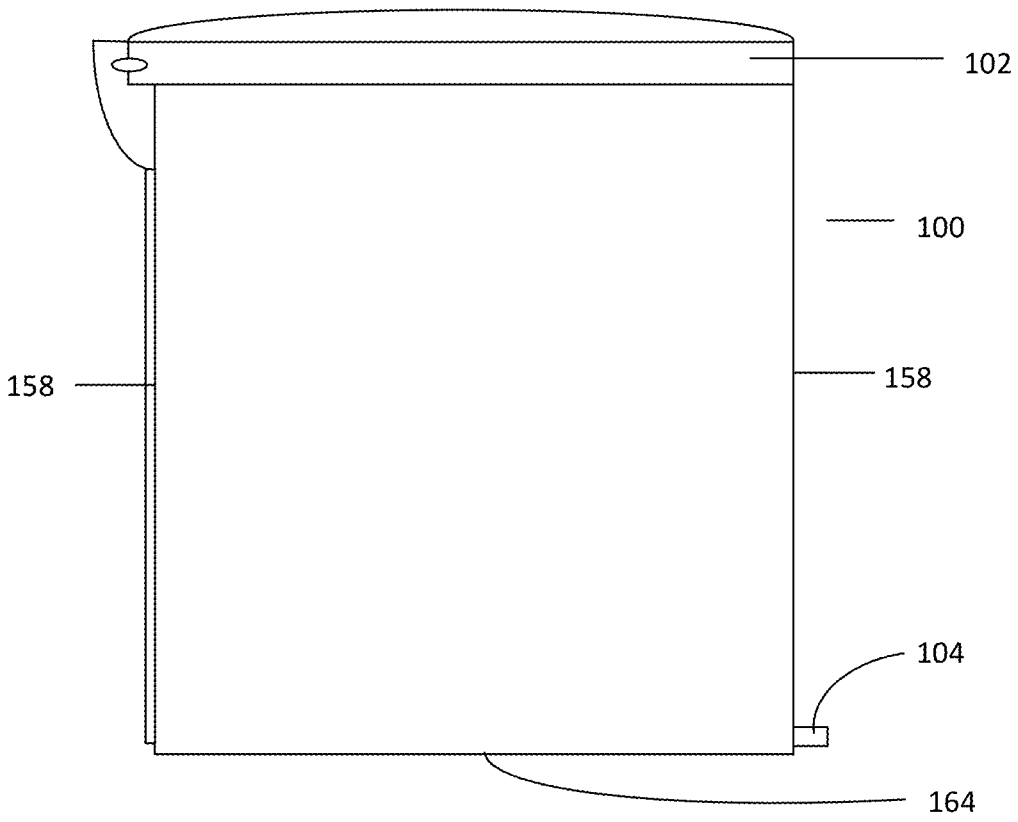
FIG. 1 is a side view of a bin.

Referring to FIG. 1, there is shown a side view of a bin 100 used for the disposal of trash and collection of recycled material. The bin having surrounding wall 158 and a closed bottom end 164 configured to create a base with an interior chamber. A lid 102 is connected to the top of the bin 100. A pedal 104 is configured for activating opening of the lid 102.

Figure 2:
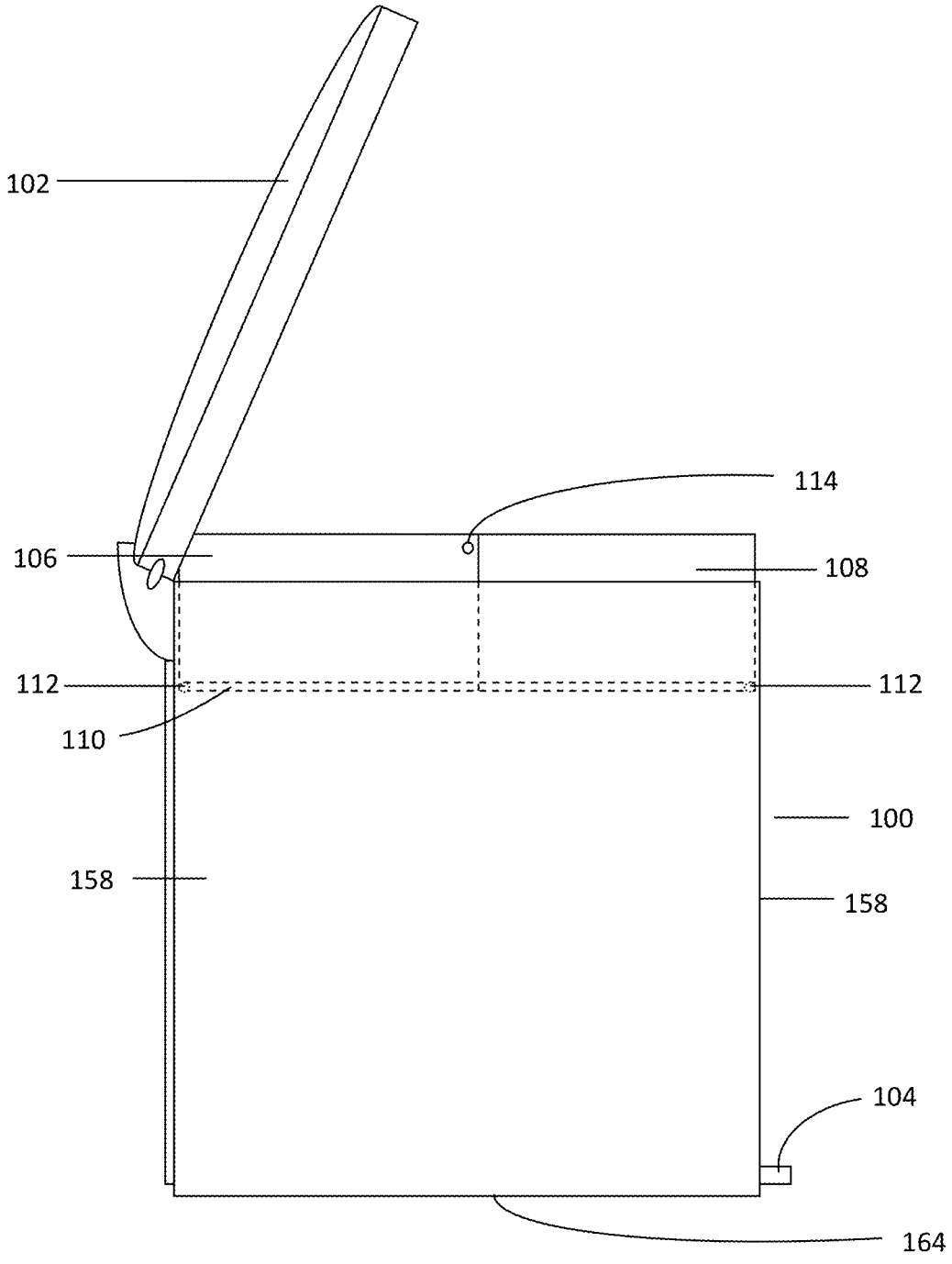
FIG. 2 is a side view of the bin of FIG. 1.

Referring to FIG. 2, there is shown a side view of the bin 100 of FIG. 1. The bin having surrounding wall 158 and a closed bottom end 164 configured to create a base with an interior chamber. A lid 102 is connected to the top of the bin 100. A pedal 104 is configured for activating opening of the lid 102. A slideable telescopic top portion of bin 100 comprising of slideable telescopic member 106 and slideable telescopic member 108 partially configured within the interior chamber of the bin 100. A guide track 110 and rollers 112 are configured within the bin for slideable telescopic member 106 and slideable telescopic member 108 to slide relative to guide track 110. Configured on slideable telescopic member 106 and slideable telescopic member 108 is a lock mechanism 114 to secure the slideable telescopic top portion in a locked position.

Figure 3:
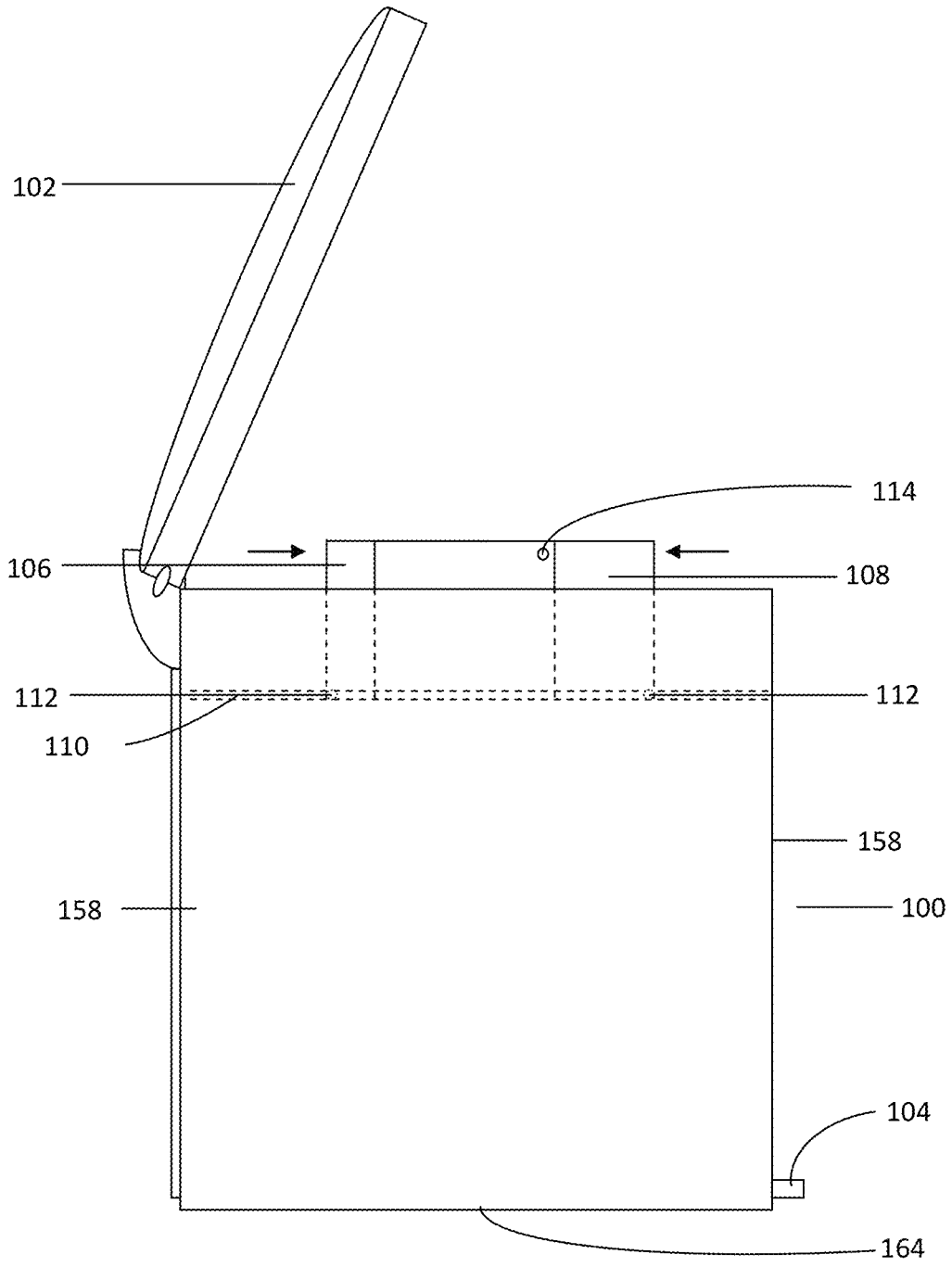
FIG. 3 is a side view of the bin of FIG. 1.

Referring to FIG. 3, there is shown a side view of the bin 100 of FIG. 1. This FIG. includes all of the aspects of FIG. 2 but shows the slideable telescopic member 106 and slideable telescopic member 108 in a retracted position.

Figure 4:
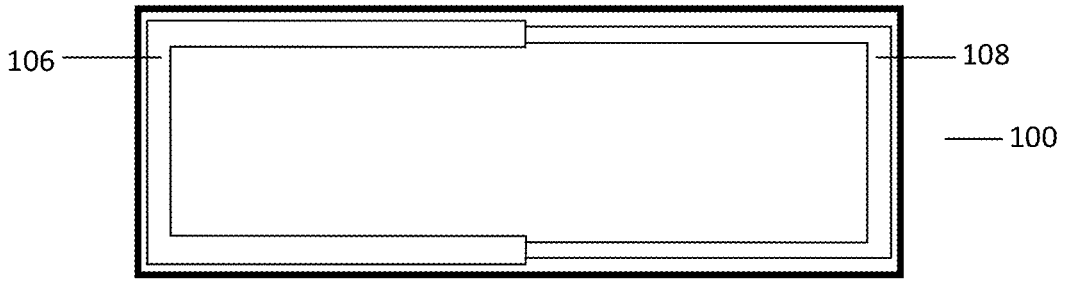
FIG. 4 is a top view of the interior chamber of the bin of FIG. 1.

Referring to FIG. 4, there is shown a top view of the interior chamber of the bin 100 of FIG. 1 with slideable telescopic member 106 and slideable telescopic member 108 in an extended position.

Figure 5:
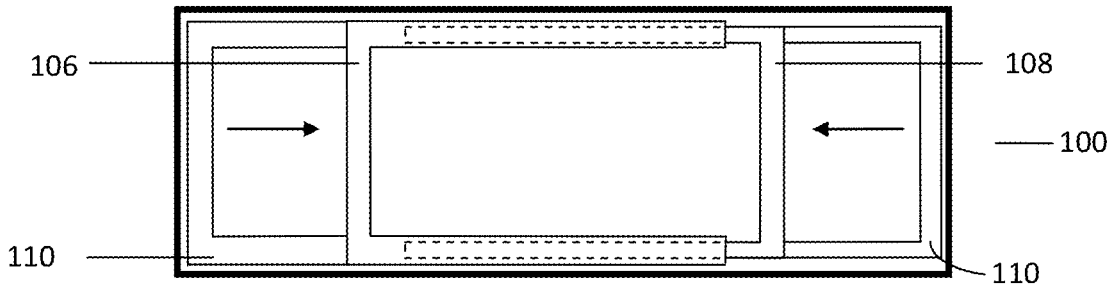
FIG. 5 is a top view of the interior chamber of the bin of FIG. 1.

Referring to FIG. 5, there is shown a top view of the interior chamber of the bin 100 of FIG. 1 with slideable telescopic member 106 and slideable telescopic member 108 in a retracted position relative to guide track 110.

Figure 6:
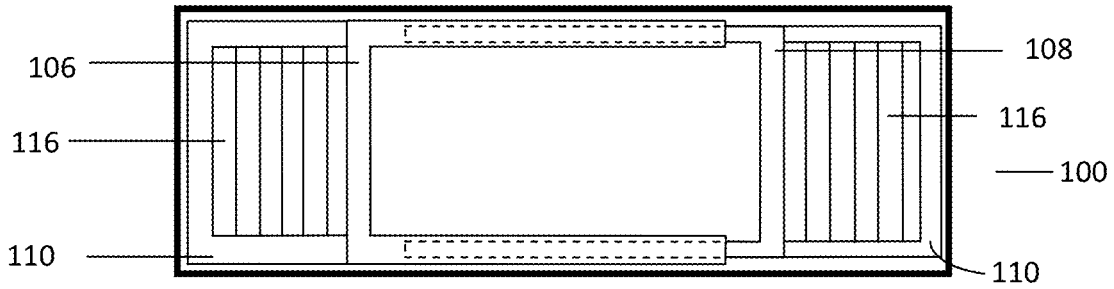
FIG. 6 is a top view of another embodiment of the interior chamber of a bin.

Referring to FIG. 6, there is shown another embodiment of a top view of the interior chamber of a bin 100 with slideable telescopic member 106 and slideable telescopic member 108 in a retracted position relative to guide track 110. A plurality of plates 116 is coupled to slideable telescopic member 106 and slideable telescopic member 108. The plurality of plates 116 present in the space between the rest of the bin and the slideable telescopic member 106 and slideable telescopic member 108 when retracted.

Figure 7:
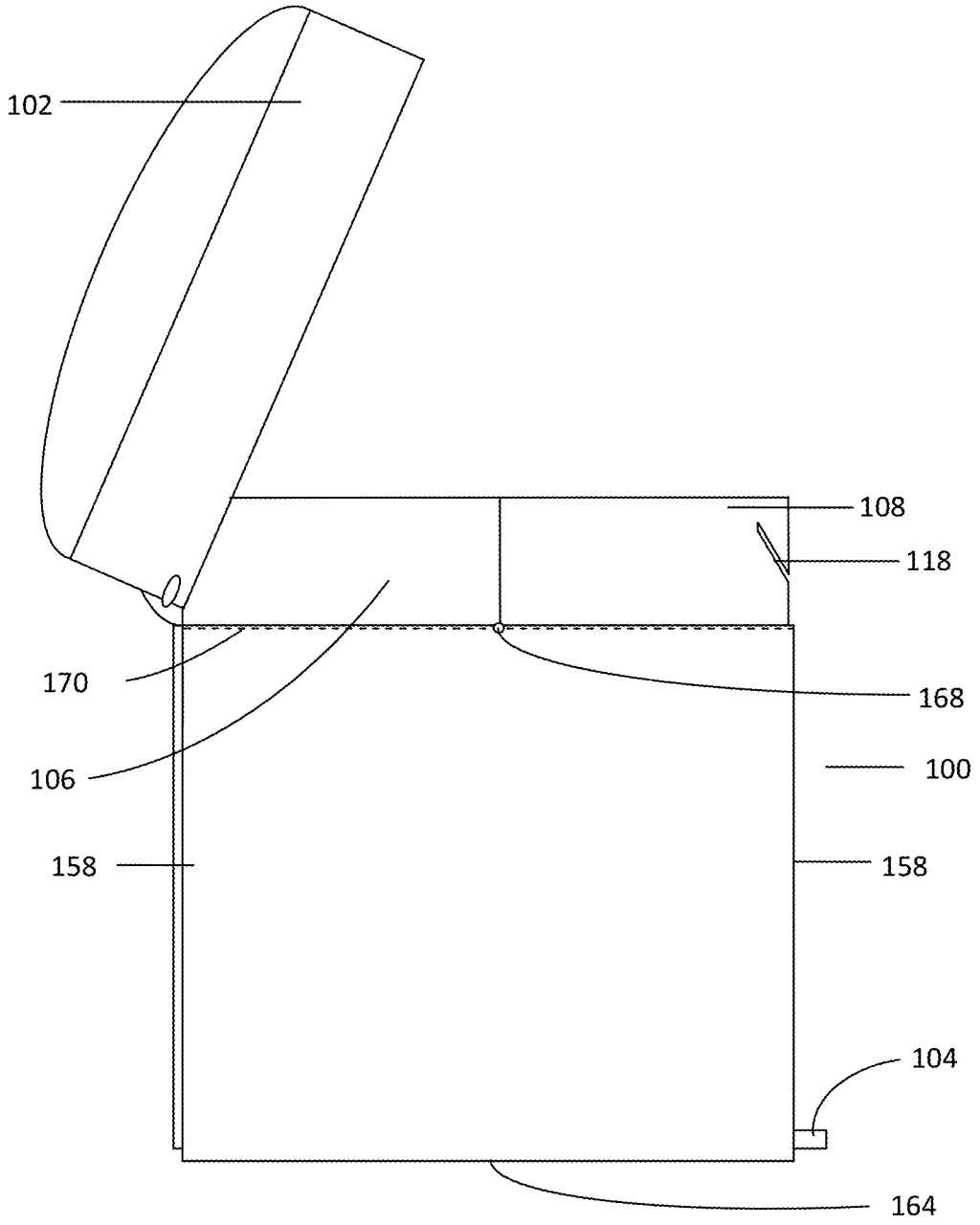
FIG. 7 is a side view of a bin.

Referring to FIG. 7, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A slideable telescopic top portion of bin 100 comprising of slideable telescopic member 106 and slideable telescopic member 108 configured on top the bin 100 periphery on guide track 110. Configured on slideable telescopic member 106 and slideable telescopic member 108 is horizontal rack gear 170. Located between horizontal rack gear 170 of slideable telescopic member 106 and slideable telescopic member 108 is pinion gear 168. Configured on slideable telescopic member 106 and slideable telescopic member 108 is a hooking mechanism 118 for receiving first and second portions of a liner with grab handles.

Figure 8:
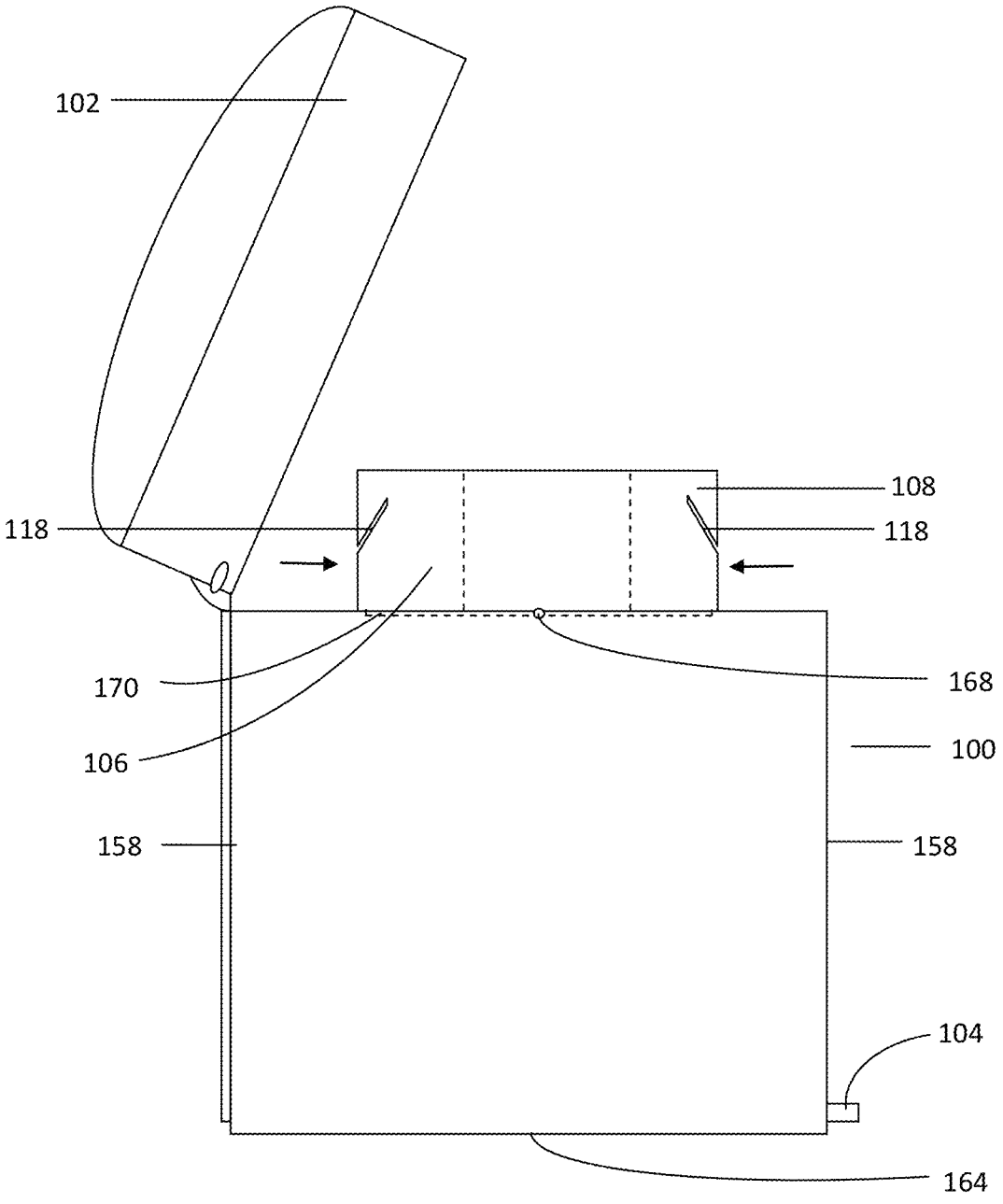
FIG. 8 is a side view of the bin of FIG. 7.

Referring to FIG. 8, there is shown a side view of the bin 100 of FIG. 7. This FIG. includes all of the aspects of FIG. 7 but shows the slideable telescopic member 106 and slideable telescopic member 108 in a retracted position.

Figure 9:
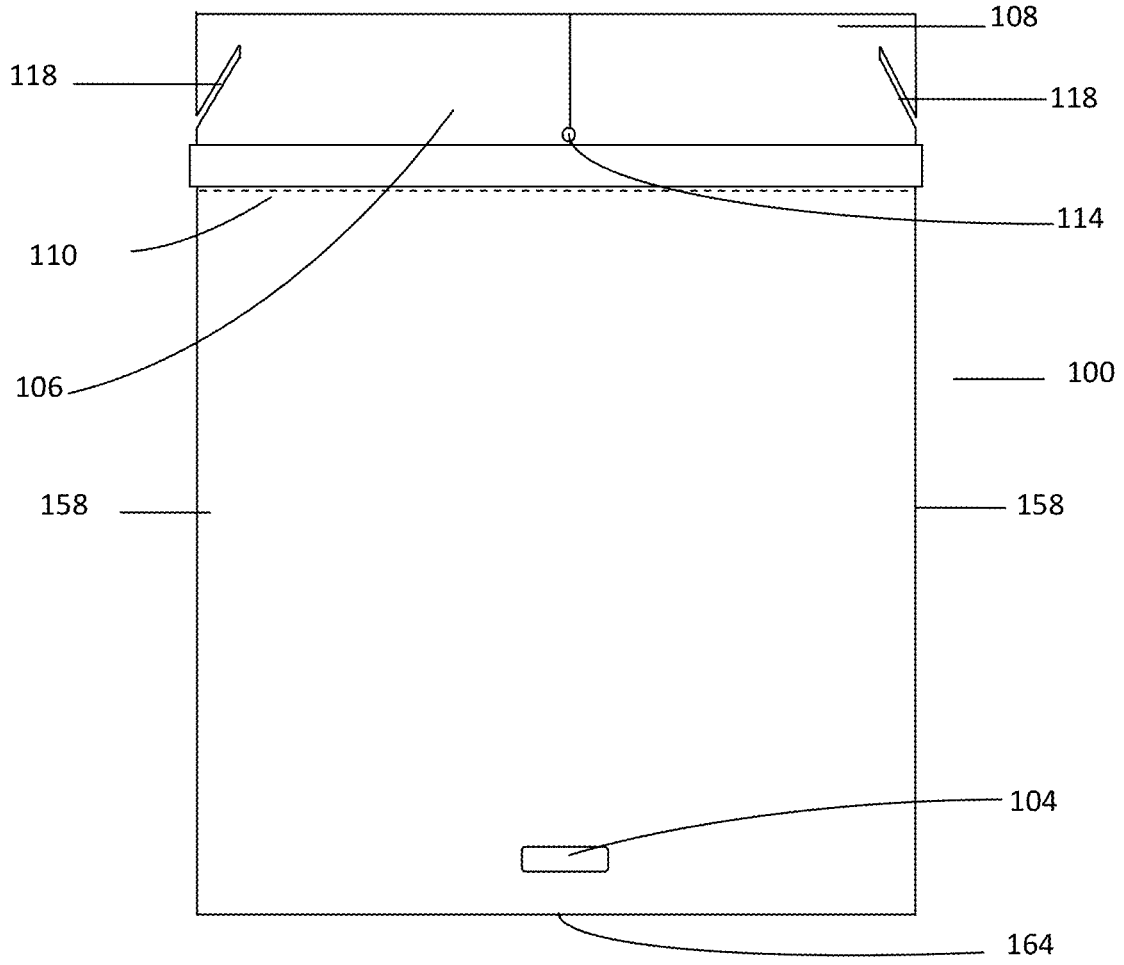
FIG. 9 is a front view of another embodiment of a bin.

Referring to FIG. 9, there is shown another embodiment of a front view of a bin 100. The bin 100 having surrounding wall 158 and a closed bottom end 164 configured to create a base with an interior chamber. The bin 100 having two slideable telescopic members 106, 108. A pedal 104 is configured for activating opening of the lid 102.

Figure 10:
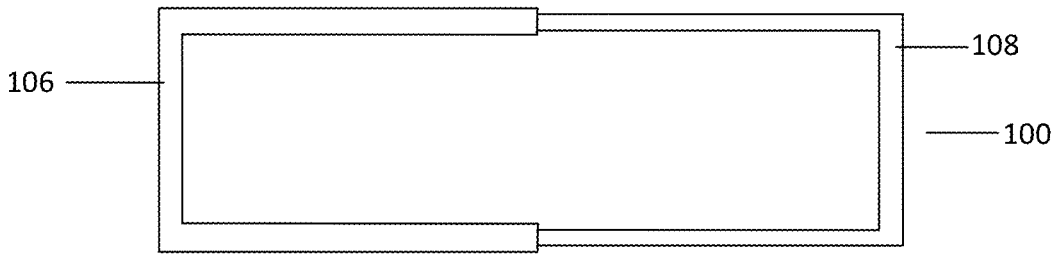
FIG. 10 is a top view of the interior chamber of the bin of FIG. 7.

Referring to FIG. 10, there is shown a top view of the interior chamber of the bin 100 of FIG. 7 with slideable telescopic member 106 and slideable telescopic member 108 in an extended position.

Figure 11:
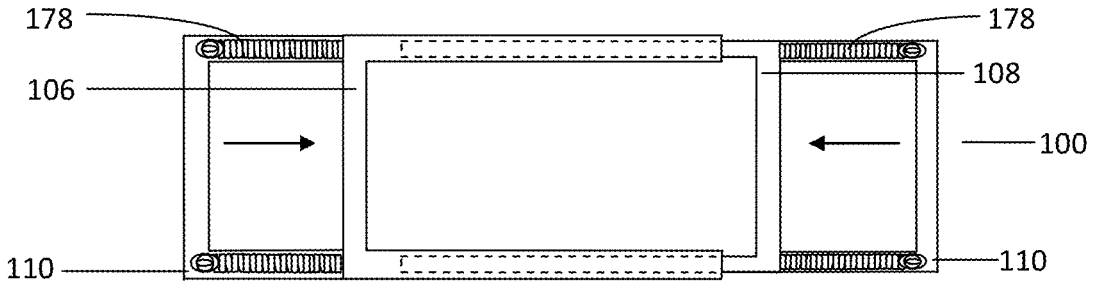
FIG. 11 is a top view of the interior chamber of the bin of FIG. 7.

Referring to FIG. 11, there is shown a top view of the interior chamber of the bin 100 of FIG. 7 with slideable telescopic member 106 and slideable telescopic member 108 in a retracted position relative to guide track 110. Coupled to slideable telescopic member 106 and slideable telescopic member 108 is spring mechanism 178 for returning the slideable members to the extended position after being retracted.

Figure 12:
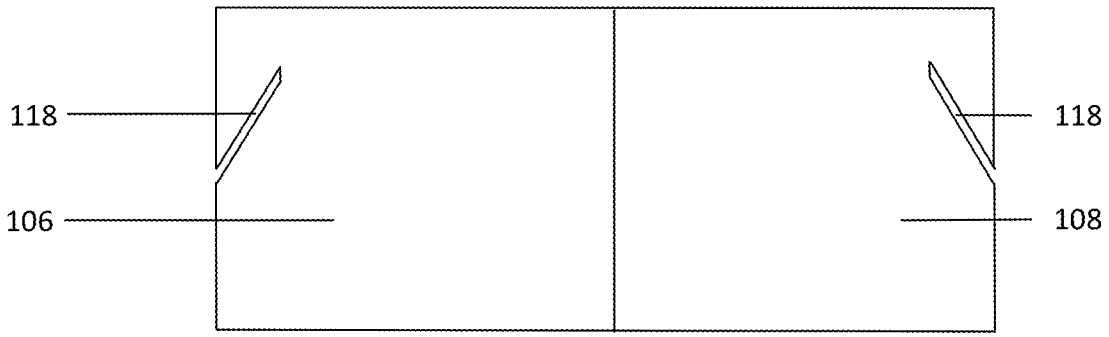
FIG. 12 is a side view of slideable telescopic members.

Referring to FIG. 12, there is shown a side view of slideable telescopic member 106 and slideable telescopic member 108 with hooking mechanism 118 configured on slideable telescopic member 106 and slideable telescopic member 108.

Figure 13:
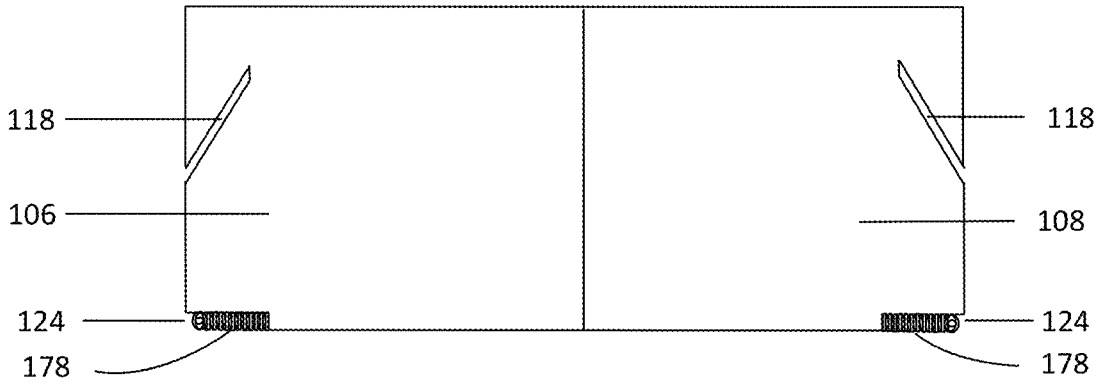
FIG. 13 is a side view of another embodiment of slideable telescopic members.

Referring to FIG. 13, there is shown a side view of another embodiment of slideable telescopic member 106 and slideable telescopic member 108 with hooking mechanism 118 and part of side wall bottom 124 of slideable telescopic member 106 and slideable telescopic member 108 elevated. Coupled to slideable telescopic member 106 and slideable telescopic member 108 is spring mechanism 178 for returning the slideable telescopic members 106, 108 to the extended position after being retracted.

Figure 14:
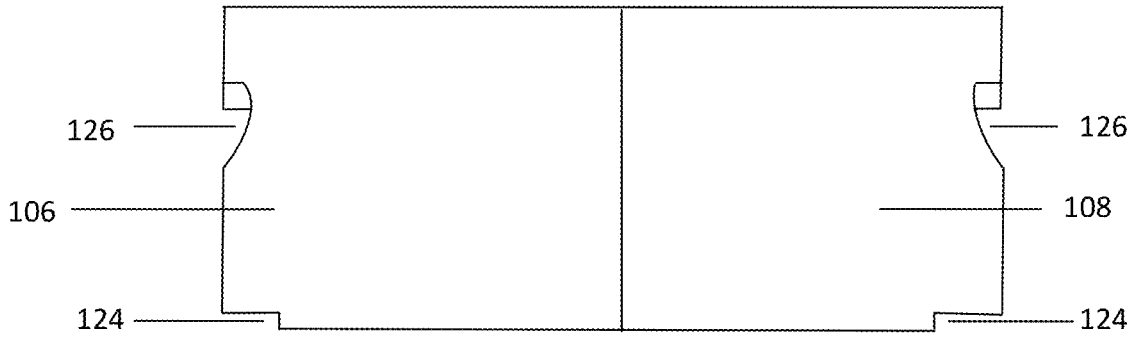
FIG. 14 is a side view of another embodiment of slideable telescopic members.

Referring to FIG. 14, there is shown a side view of another embodiment of slideable telescopic member 106 and slideable telescopic member 108 with handle 126 and part of side wall bottom 124 of slideable telescopic member 106 and slideable telescopic member 108 elevated.

Figure 15:
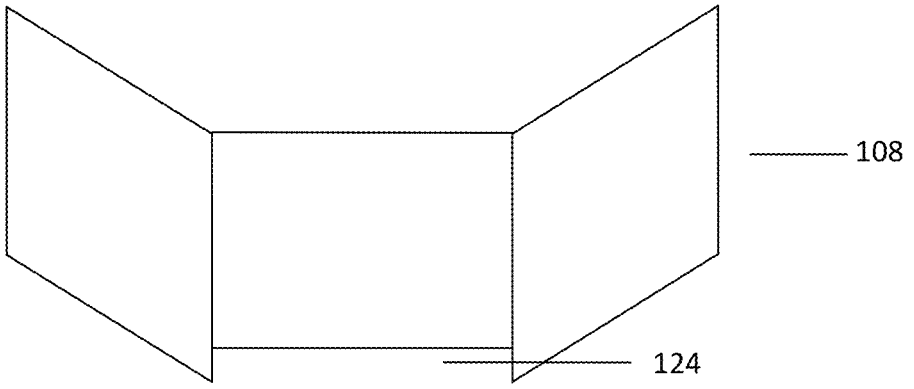
FIG. 15 is a perspective view of a slideable telescopic member.

Referring to FIG. 15, there is shown a perspective view of slideable telescopic members 106, 108 and part of side wall bottom 124 of slideable telescopic members 106, 108 elevated.

Figure 16:
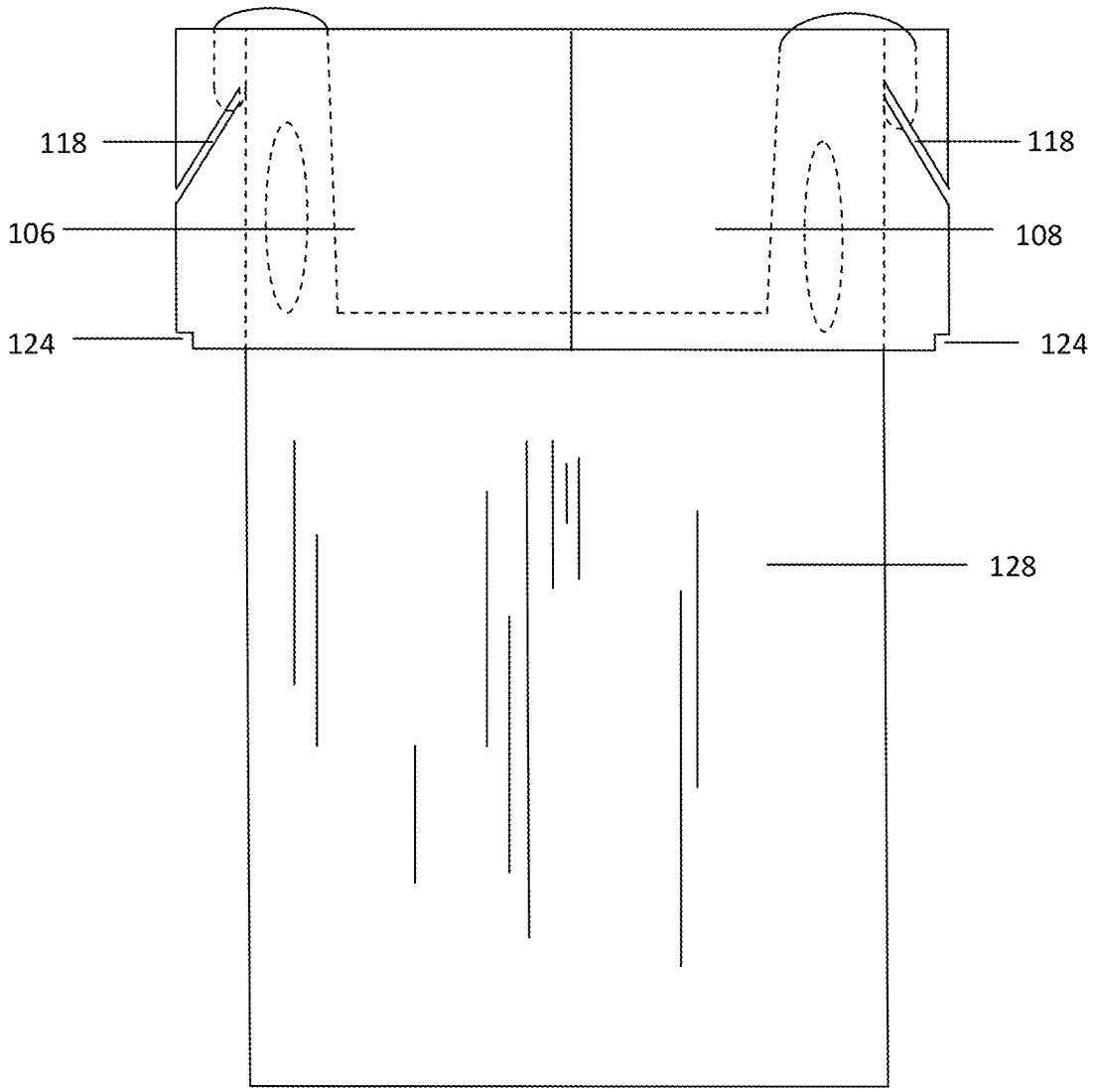
FIG. 16 is a side view of the slideable telescopic members of FIG. 13 engaged with a liner with grab handles.

Referring to FIG. 16, there is shown a side view of the slideable telescopic member 106 and slideable telescopic member 108 of FIG. 13 having part of side wall bottom 124 of slideable telescopic member 106 and slideable telescopic member 108 elevated, wherein a liner 128 with grab handles has been inserted and is being secured by hooking mechanism 118.

Figure 17:
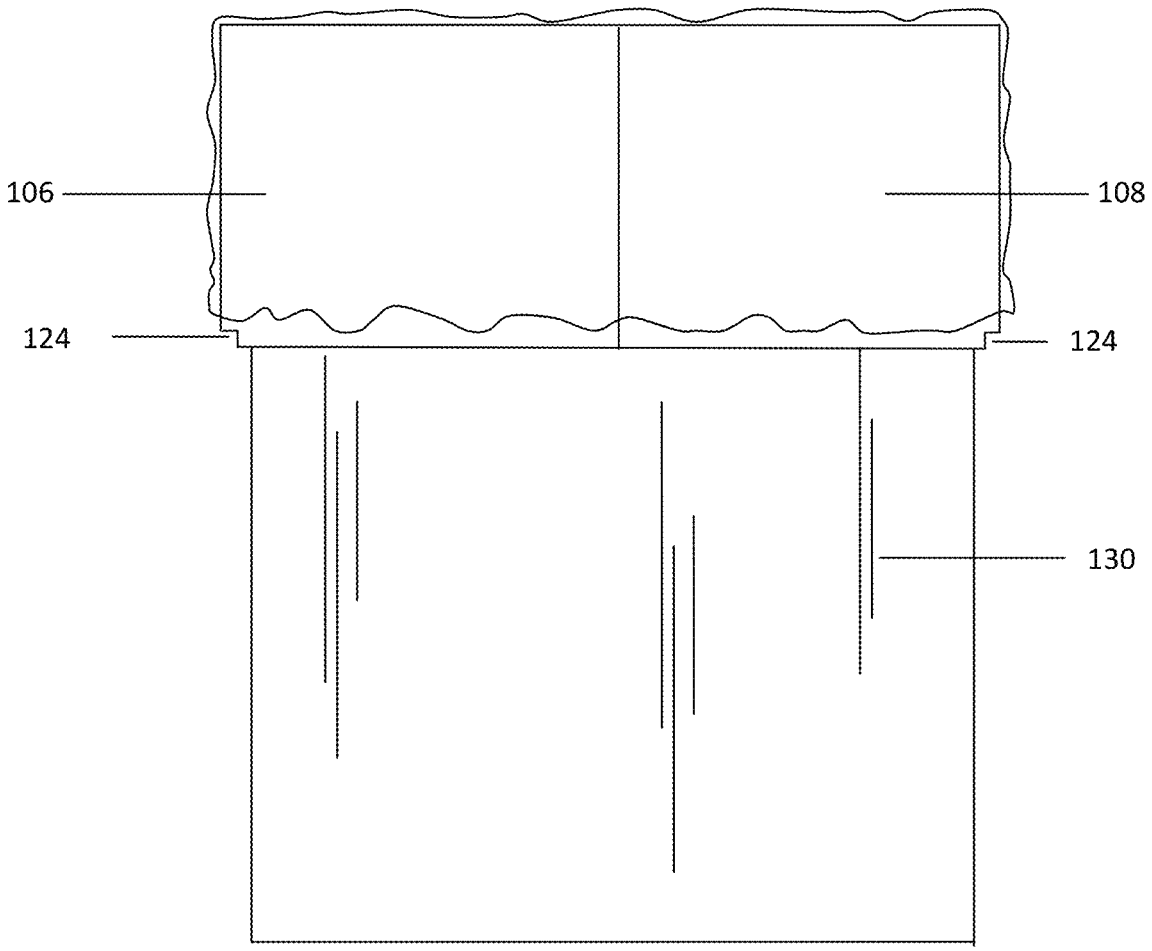
FIG. 17 is a side view of another embodiment of a slideable telescopic top portion engaged with a liner with no grab handles.

Referring to FIG. 17, there is shown a side view of another embodiment of slideable telescopic member 106 and slideable telescopic member 108 having part of side wall bottom 124 of slideable telescopic member 106 and slideable telescopic member 108 elevated, wherein a liner 130 with no grab handles has been inserted.

Figure 18:
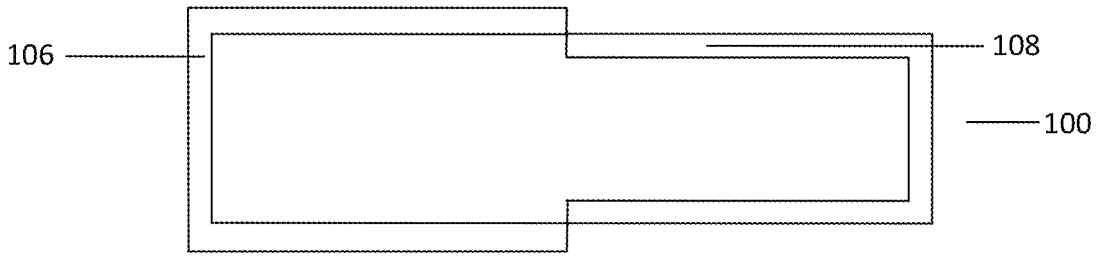
FIG. 18 is a top view of another embodiment of the interior chamber of a bin.

Referring to FIG. 18, there is shown a top view of another embodiment of the interior chamber of a bin 100 with slideable telescopic member 106 and slideable telescopic member 108 in an extended position.

Figure 19:
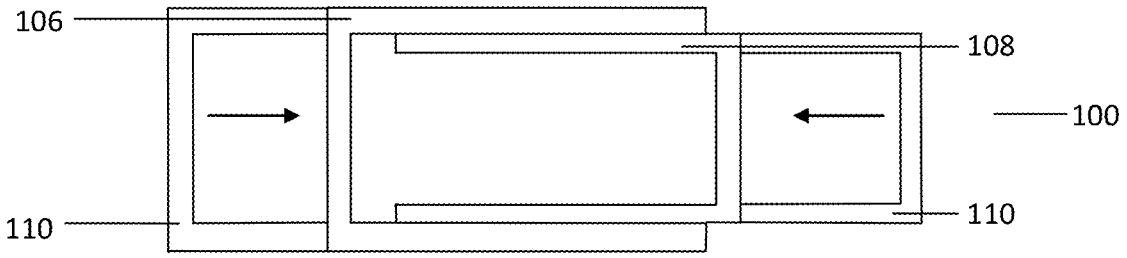
FIG. 19 is a top view of the interior chamber of the bin of FIG. 18.

Referring to FIG. 19, there is shown a top view of the interior chamber of the bin 100 of FIG. 18 with slideable telescopic member 106 and slideable telescopic member 108 in a retracted position relative to guide track 110.

Figure 20:
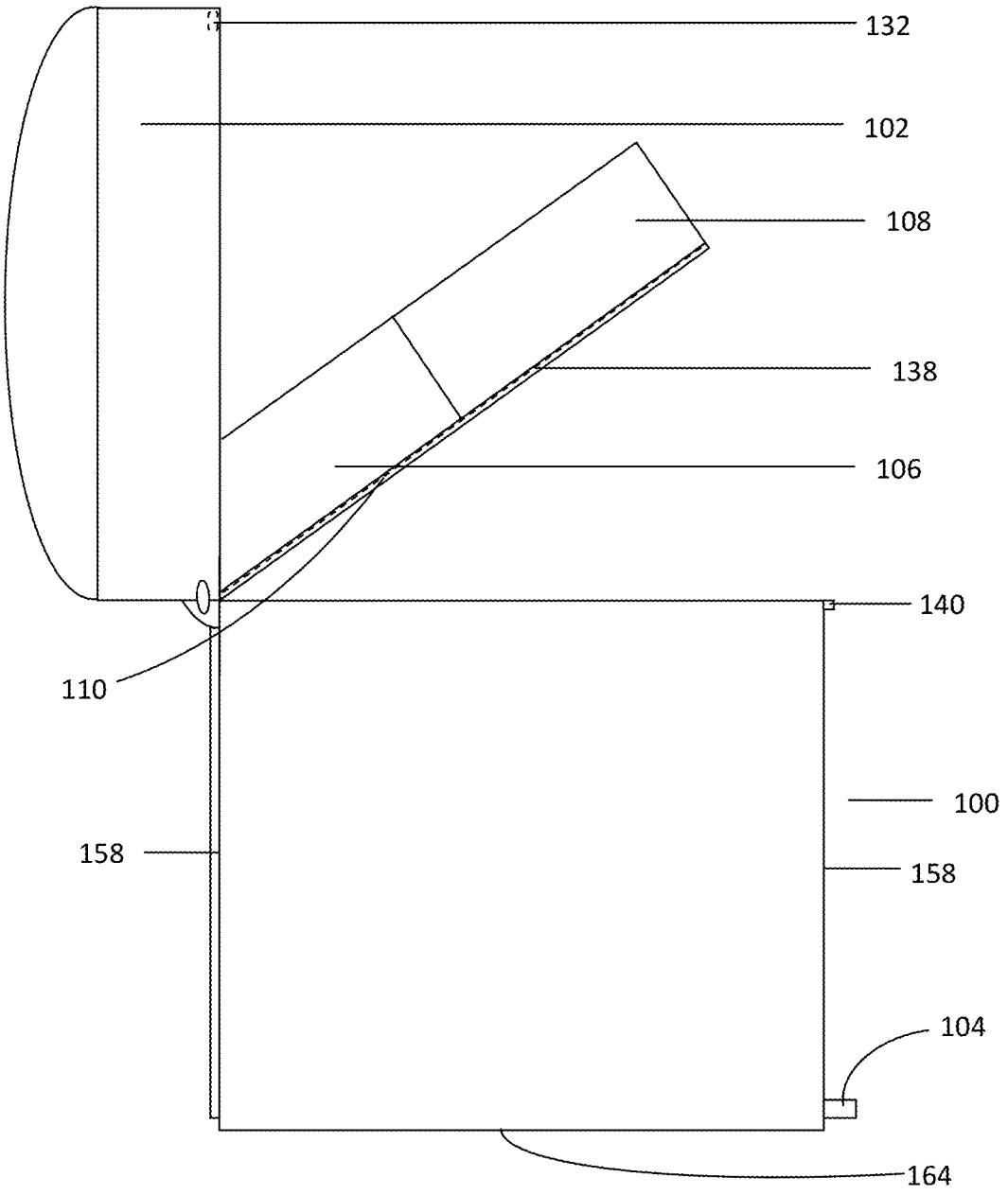
FIG. 20 is a side view of a bin.

Referring to FIG. 20, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A base member 138 having slideable telescopic member 106 and slideable telescopic member 108 configured on base member 138. Guide track 110 is configured on base member 138 for engaging slideable telescopic member 106 and slideable telescopic member 108. The bin 100 having a securing mechanism 132 configured on lid 102 to secure base member 138 within lid 102. The bin 100 further having a securing mechanism 140 configured to secure lid member 138 to the bin 100.

Figure 21:
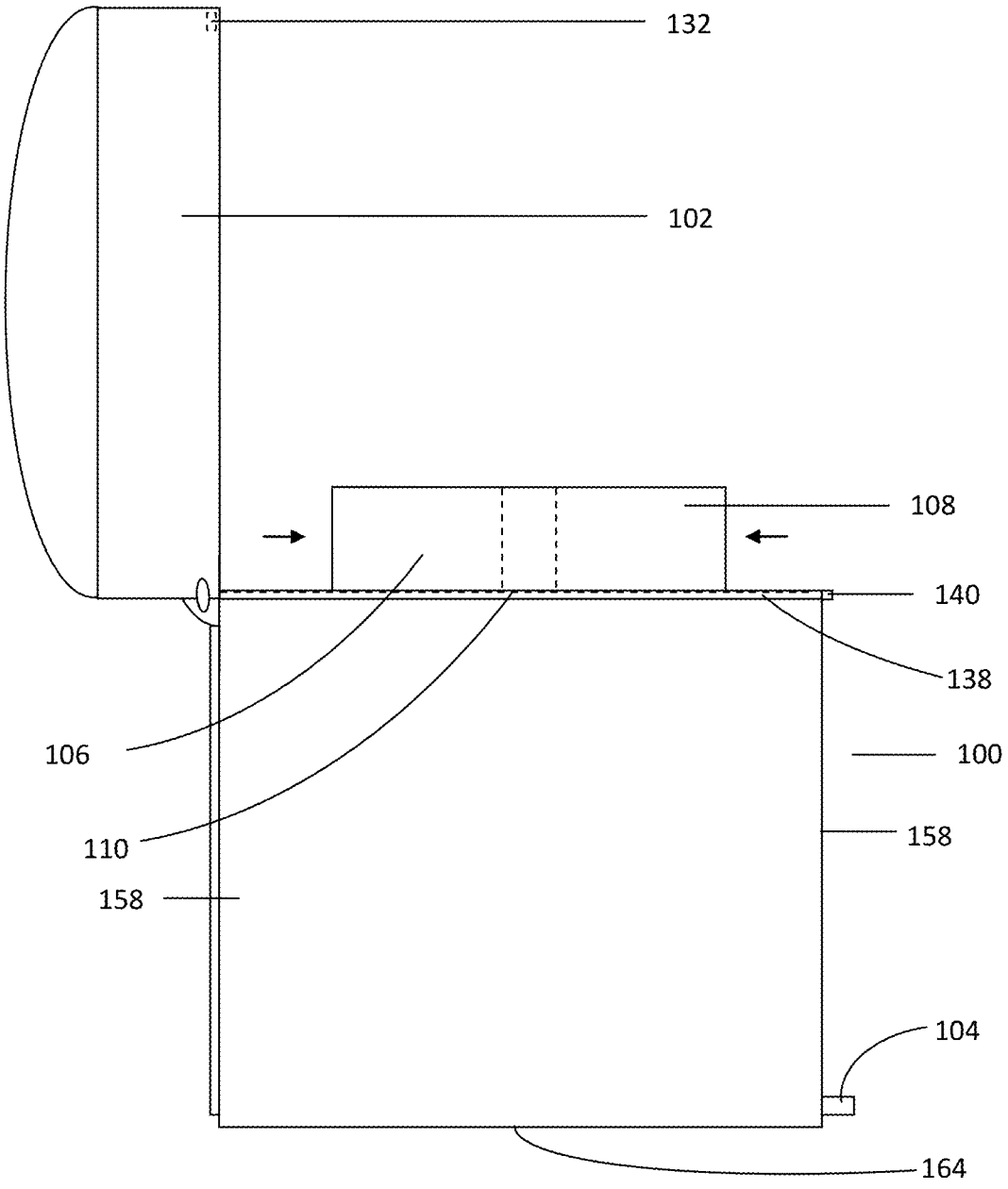
FIG. 21 is a side view of the bin of FIG. 20.

Referring to FIG. 21, there is shown a side view of the bin 100 of FIG. 20. This FIG. includes all of the aspects of FIG. 20 but shows the slideable telescopic member 106 and slideable telescopic member 108 of base member 138 in a retracted position.

Figure 22:
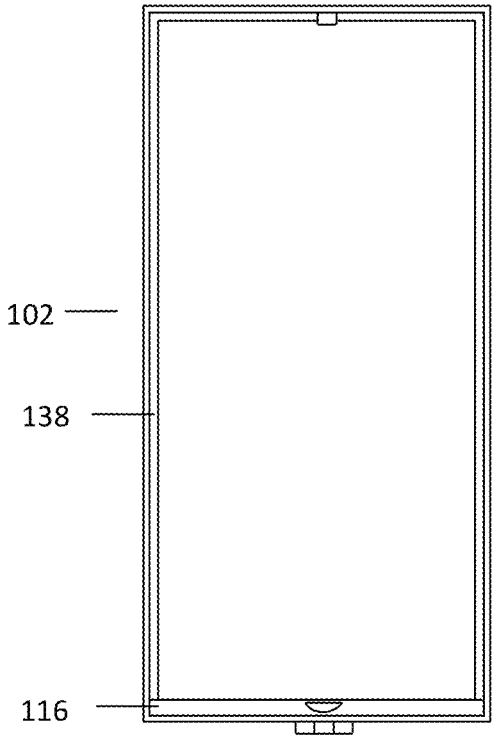
FIG. 22 is a bottom view of a lid.

Referring to FIG. 22, there is shown a bottom view of a lid 102. The lid having base member 138 within the lid 102. Present on lid 102 is a plurality of plates 116 for concealing the base member 138 within the lid 102.

Figure 23:
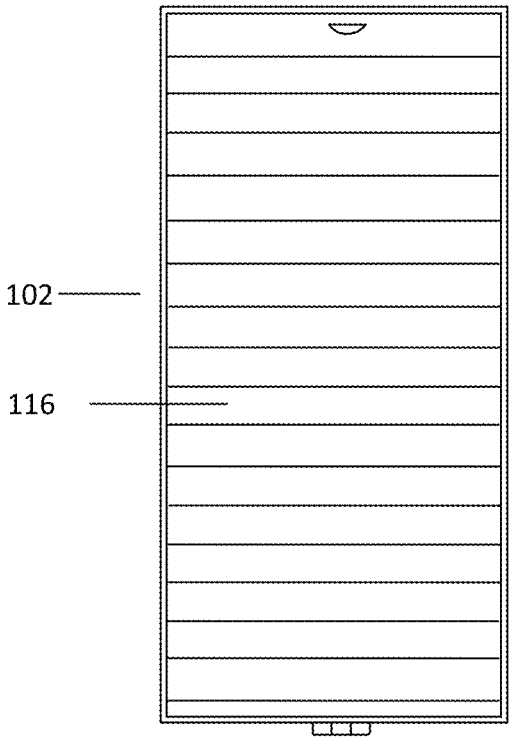
FIG. 23 is a bottom view of the lid of FIG. 22.

Referring to FIG. 23, there is shown a bottom view of the lid 102 of FIG. 22. This FIG. includes all of the aspects of FIG. 22 but shows base member 138 concealed by plurality of plates 116.

Figure 24:
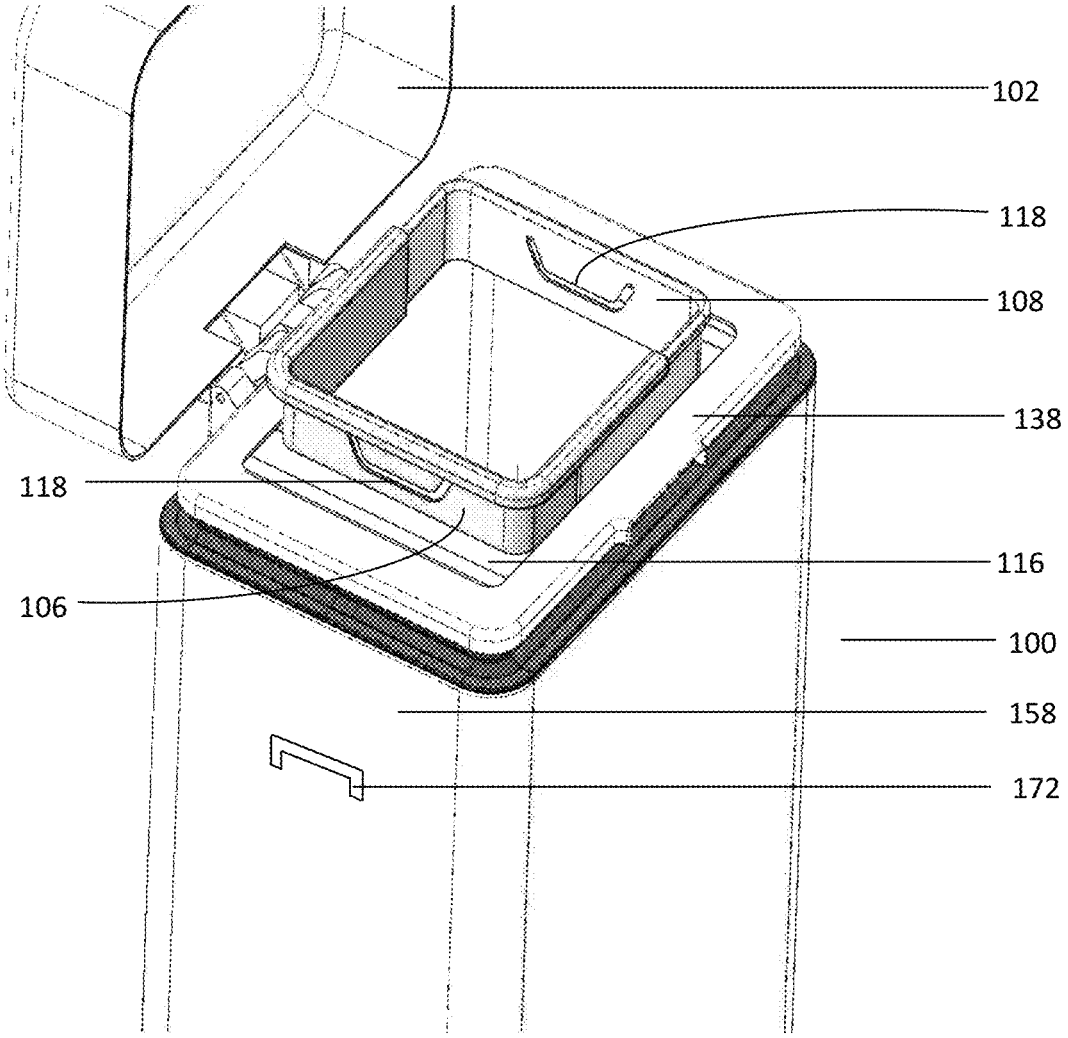
FIG. 24 is a perspective view of a bin.

Referring to FIG. 24, there is shown a perspective view of a bin 100. The bin having surrounding wall 158 and a closed bottom end 164 configured to create a base with an interior chamber. A lid 102 is connected to the top of the bin 100. A base member 138 having slideable telescopic member 106 and slideable telescopic member 108 configured on base member 138. Configured on slideable telescopic member 106 and slideable telescopic member 108 is hooking mechanism 118 for receiving first and second portions of a liner with grab handles. Configured on surrounding wall 158 is hooking mechanism 172 for receiving first and second portions of a liner with grab handles.

Figure 25:
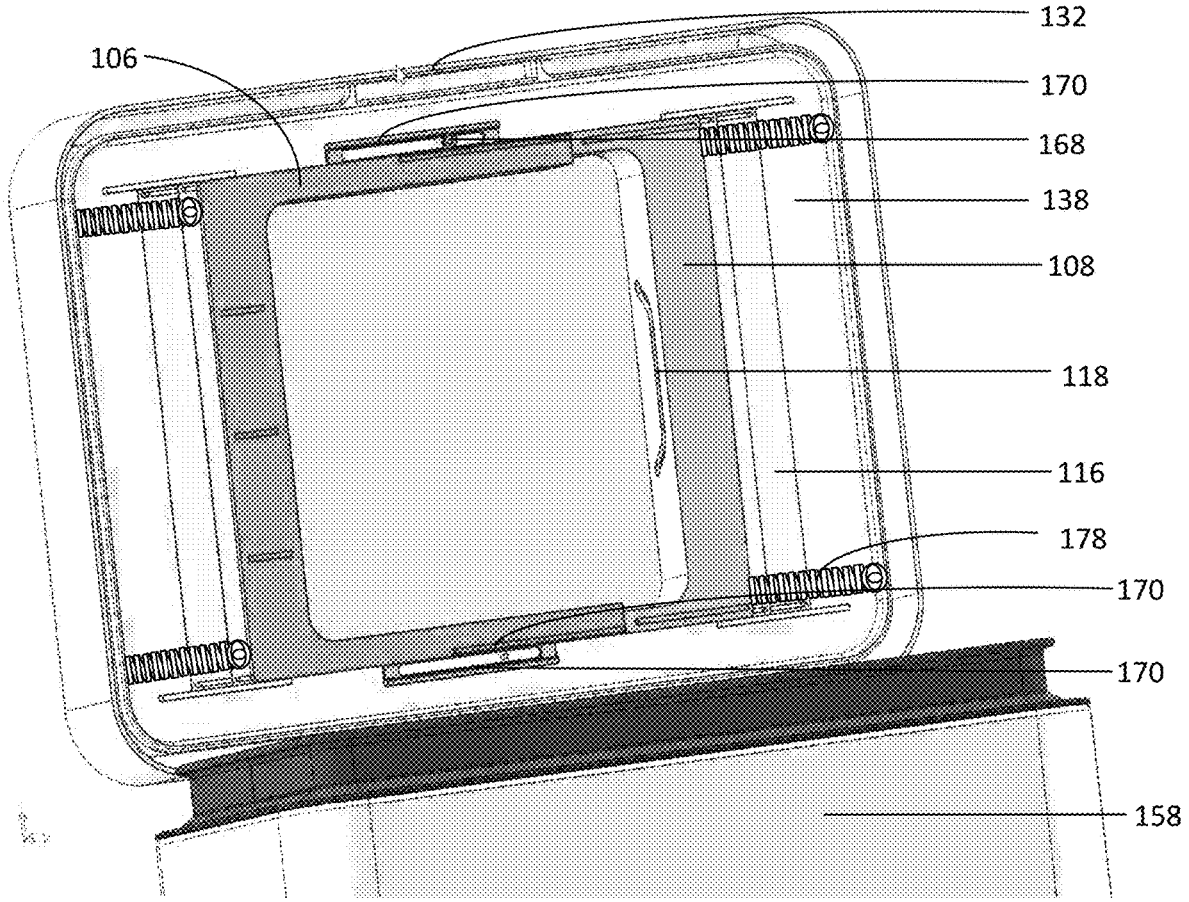
FIG. 25 is a bottom view of the interior chamber of the base member of the bin of FIG. 24.

Referring to FIG. 25, there is shown a bottom view of the interior chamber of the base member 138 of the bin 100 of FIG. 24. Base member 138 having slideable telescopic member 106 and slideable telescopic member 108 configured on base member 138. Configured on slideable telescopic member 106 and slideable telescopic member 108 is hooking mechanism 118 for receiving first and second portions of a liner with grab handles. Coupled to slideable telescopic member 106 and slideable telescopic member 108 is spring mechanism 178 for returning the slideable members to the extended position after being retracted. Configured on slideable telescopic member 106 and slideable telescopic member 108 is horizontal rack gear 170.

Located between horizontal rack gear 170 of slideable telescopic member 106 and slideable telescopic member 108 is pinion gear 168 for controlling horizontal rack gear 170.

Figure 26:
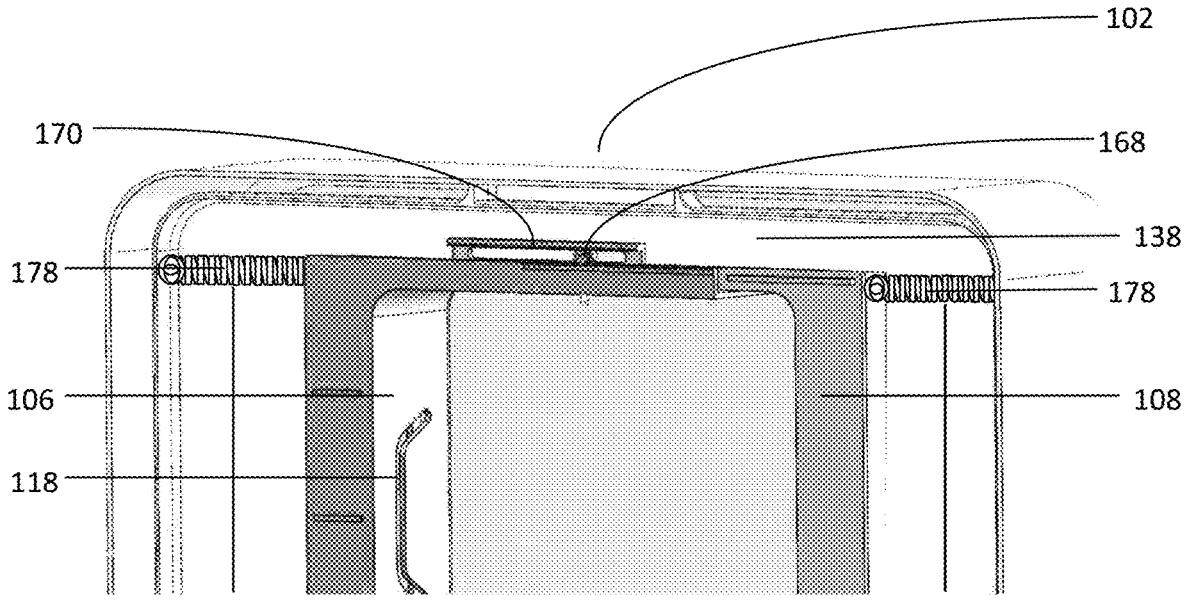
FIG. 26 is a bottom view of the interior chamber of the base member of the bin of FIG. 24.

Referring to FIG. 26, there is shown a bottom view of the interior chamber of the base member of the bin 100 of FIG. 24. This FIG. includes all the aspects of FIG. 25.

Figure 27:
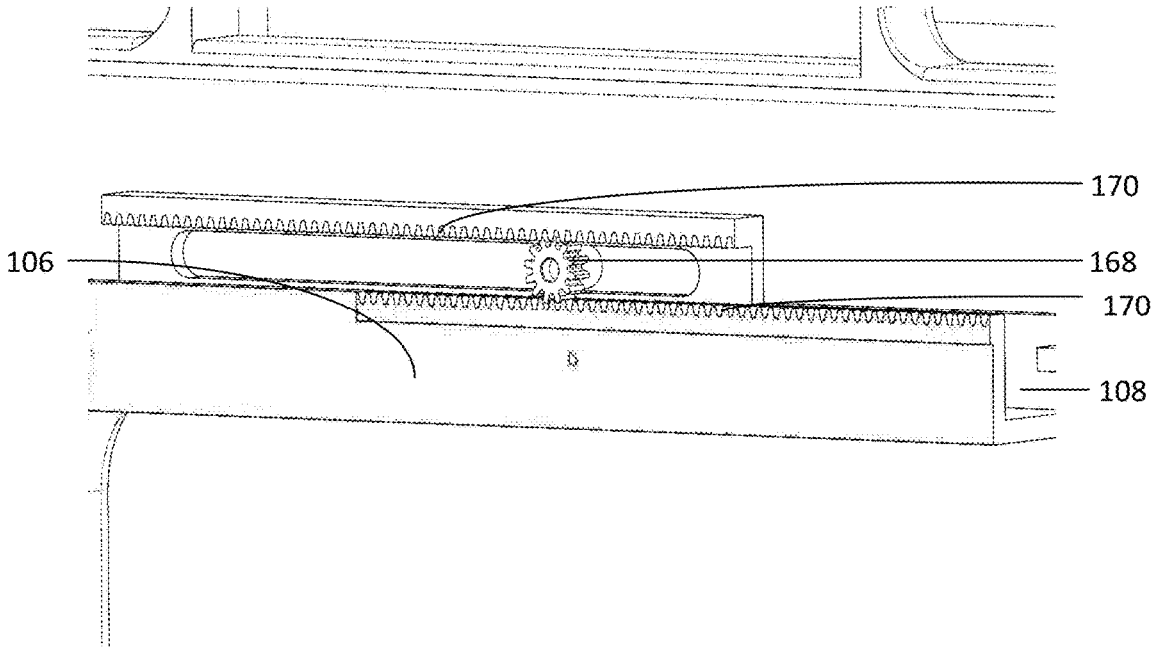
FIG. 27 is a bottom view of the interior chamber of the base member of the bin of FIG. 24.

Referring to FIG. 27, there is shown a bottom view of the interior chamber of the base member of the bin 100 of FIG. 24. Configured on slideable telescopic member 106 and slideable telescopic member 108 is horizontal rack gear 170. Located between horizontal rack gear 170 of slideable telescopic member 106 and slideable telescopic member 108 is pinion gear 168 for controlling horizontal rack gear 170.

Although the invention has been illustrated and described in the drawings and foregoing description, the same is to be considered as illustrative and not restrictive in character—it being understood that only preferred embodiments have been shown and described, and that all changes and modifications that come within the spirit of the invention as claimed are desired to be protected. Undoubtedly, many other "modifications" and "variations" on the "themes" set forth hereinabove will occur to one having ordinary skill in the art to which the present invention most nearly pertains, and such variations are intended to be within the scope of the invention, as disclosed herein. The size, shape, length, width, location and materials of the various components may vary without departing from the spirit of the invention. Many of the embodiments listed may be combined with each other to form additional embodiments of the bin and lid. The use of certain singular and plural terms like "an", "a", "it", "their", "is", "are" and similar terms while describing the present invention are to be interpreted to cover both singular and plural. The use of the term "and" while describing the present invention is to be interpreted to also cover the term "or". Furthermore, any combination of the described elements in all variations possible thereof is covered by the invention unless otherwise indicated. The terms "possessing", "having", "containing," "including," and other similar terms are to be interpreted as open-ended terms (i.e., meaning "including, but not limited to,") unless otherwise noted.

The invention claimed is:

1. A bin comprising: a surrounding wall and a closed bottom end, said surrounding wall and said closed bottom end configured to create a base with an interior chamber; a top opening to the interior chamber; at least a top portion of the bin comprising at least two slideable members; the slideable members movable between an extended position to receive a larger liner within the interior chamber and a retracted position to receive a smaller liner within the interior chamber; wherein the slideable members allows for the top opening of the bin to be adjusted in periphery; at least a spring mechanism coupled to the slideable members; the spring mechanism returning the slideable members to the extended position after being retracted.

2. The bin of claim 1, wherein the slideable members are telescopic.

3. The bin of claim 1, wherein the slideable members include a first slideable member that slides between another slideable member.

4. The bin of claim 1, wherein the slideable members comprise of at least a horizontal rack gear.

5. The bin of claim 4, wherein the horizontal rack gear is controlled by at least a pinion gear.

6. The bin of claim 1, wherein the slideable members are pivotably connected to the bin and to a lid via a base member.

7. The bin of claim 6, further comprising a securing mechanism configured to secure the slideable members via the base member to the bin.

8. The bin of claim 6, further comprising a securing mechanism configured to secure the slideable members via the base member within the lid.

9. The bin of claim 6, further comprising at least a guide track on the base member for the slideable members to slide relative to.

10. The bin of claim 6, wherein at least one end of the spring mechanism is coupled to the slideable members and at least another end coupled to the base member.

11. The bin of claim 6, further comprising a pedal actuator configured for opening the lid.

12. The bin of claim 6, further comprising a dampening mechanism configured for dampening movement of the lid at least from an open position to a closed position.

13. The bin of claim 1, wherein at least one end of the spring mechanism is coupled to the slideable members and at least another end coupled to an interior of the surrounding wall of the bin.

14. The bin of claim 1, further comprising at least a hooking mechanism configured on the slideable members for receiving first and second portions of a liner.

15. The bin of claim 1, further comprising at least a guide track on the bin so that the slideable members can slide relative to the guide track.

16. The bin of claim 15, further comprising at least a roller to improve movement of the slideable members relative to the guide tracks.

17. The bin of claim 1, further comprising an unlock mechanism configured to selectively release the slideable members from the retracted position to the extended position.

18. The bin of claim 1, further comprising at least a flexible scrolling member coupled to the slideable members; the flexible scrolling member present in a space between the slideable members and a rest of the bin when retracted.

19. The bin of claim 18, further comprising guide tracks present to enable the flexible scrolling member to slide relative to the guide tracks.

20. The bin of claim 1, further comprising a plurality of plates coupled to the slideable members; the plurality of plates present in a space between the slideable members and a rest of the bin when retracted.

21. The bin of claim 20, wherein each of the plates is hingedly coupled to a following one of the plates.

22. The bin of claim 20, further comprising guide tracks present to enable the plurality of plates to slide relative to the guide tracks.

23. The bin of claim 1, further comprising at least a handle configured on the slideable members for extension and retraction of the slideable members.

24. The bin of claim 1, further comprising at least a hooking mechanism configured on the surrounding wall of the bin for receiving first and second portions of a liner.

* * * * *